United States Patent [19]

Auth et al.

[11] Patent Number: 4,658,772

[45] Date of Patent: Apr. 21, 1987

[54] SYSTEM FOR CONTROLLING THE TEMPERATURE OF A HOT SPOT OR A GLOW PLUG IN AN INTERNAL COMBUSTION ENGINE

[75] Inventors: Werner Auth, Stuttgart; Martin Lenfers, Hemmingen; Johannes Locher, Stuttgart; Hans-J. Peter, Markgröningen; Hannes Pflug, Gerlingen; Michel Friedbert, Ostfildern; Josef Steiner, Esslingen, all of Fed. Rep. of Germany

[73] Assignee: Robert Bosch GmbH, Stuttgart, Fed. Rep. of Germany

[21] Appl. No.: 739,968

[22] Filed: May 31, 1985

[30] Foreign Application Priority Data

Jun. 1, 1984 [DE] Fed. Rep. of Germany ..... 3420484
Jan. 30, 1985 [DE] Fed. Rep. of Germany ..... 3502966

[51] Int. Cl.[4] ..... F02P 19/02
[52] U.S. Cl. ..... 123/145 A; 123/179 H
[58] Field of Search ..... 123/145 A, 179 B, 179 BG, 123/179 H

[56] References Cited

U.S. PATENT DOCUMENTS 4,162,669 7/1979 Igashira et al. ..... 123/145 A
4,327,689 5/1982 Rachel ..... 123/436
4,438,496 3/1984 Ohie ..... 123/478
4,512,307 4/1985 Igashira et al. ..... 123/179 H

FOREIGN PATENT DOCUMENTS 2629846 3/1977 Fed. Rep. of Germany ... 123/145 A
59-18275 1/1984 Japan ..... 123/145 A
2051227A 1/1981 United Kingdom .
2150976A 7/1985 United Kingdom .

*Primary Examiner*—Andrew M. Dolinar
*Attorney, Agent, or Firm*—Frishauf, Holtz, Goodman & Woodward

[57] ABSTRACT

A glow plug electrically heated during start-up to help bring the air-fuel mixture of an internal combustion engine to ignition temperature when the engine is cold, instead of being turned off as soon as the engine is running, has its heating current controlled so as to maintain the glow plug temperature within a desired range, as the result of which the engine can be made to run more quietly and more smoothly under many conditions. The current control unit which varies the glow plug current responds to the output signal of a computing unit responsive to various engine operation parameters, including especially a signal representative of the rate of feeding fuel to the engine.

16 Claims, 5 Drawing Figures

SYSTEM FOR CONTROLLING THE TEMPERATURE OF A HOT SPOT OR A GLOW PLUG IN AN INTERNAL COMBUSTION ENGINE

This invention concerns a system for controlling the temperature of a glow plug or, more generally, of a hot spot, such as a glow plug used to produce on the inside of a cylinder of an internal combustion, by controlling the electric current supply to a heater for the glow plug or other hot spot.

Glow plugs and equivalent hot spots in a cylinder are used during the start-up phase of engines such as Diesel engines, in order to bring the temperature of the fuel-air mixture in the combustion chamber (cylinder) enough for it to ignite when compressed while the engine is still cold. After a successful start, when the engine is running without the help of the starter, the engine heats up enough so that the glow plug or hot spot can be switched off. It is known for this switching-off operation to be carried out in a manner dependent upon engine speed or dependent upon engine temperature.

The reason for immediate shutting off of glow plugs after a successful start of the engine is that there is a danger of destroying the glow plugs if their heaters are left on. This danger arises because when the engine is running, excessive voltages will at times be applied to the glow plugs, so that with the high combustion temperatures reigning at the same time, the glow plugs will be thermally overloaded.

The disadvantage of the above-described known systems for turning off the glow plugs is that the immediate switching off of glow plugs after a successful start of the engine there is no longer any possibility to support combustion in the combustion chambers of the engine with the help of glow plugs, as might be desirable for quiet and smooth running of the engine.

SUMMARY OF THE INVENTION

It is an object of the present invention to make use of the glow plugs or equivalent other hot spots in the combustion chambers of an internal combustion engine, not only in the start-up of the engine, but also during its normal running, especially when it is idling or running slowly, in order to make the operation of the engine quieter and smoother.

Briefly, signals representative of operating parameters of the engine, including a signal representative of the supply of fuel to the engine, are utilized to control the magnitude of an output signal which in turn controls the amount of current which passes through the heating means of the glow plug or other hot spot in the combustion chamber of the engine.

The invention has the advantage that by taking account of operation parameters characterizing the operating condition of the engine, the possibility is realized of using the glow plugs or other hot spots to modify the combustion in the combustion chambers of the engine in order to produce a quieter and smoother running of the engine in all operating ranges of the engine. With the additional taking account of a signal representative of the supply of fuel to the engine, the glow plugs or the like are protected against thermal overloads, such as might arise as the result of the concurrence of electrical heating with the high combustion temperatures. By further taking account of the voltage applied to the glow plugs, the raising of this voltage with the running of the engine and the consequent overloading of the glow plugs can also be counteracted by compensatory control of the glow plug current or voltage. Of course, a signal representative of the voltage applied to the glow plug is also representative of the current passing through the glow plug.

Further details of the invention will appear in the more elaborate description that follows.

BRIEF DESCRIPTION OF THE DRAWINGS

The invention is further described by way of illustrative example with reference to the annexed drawing in which.

DESCRIPTION OF THE ILLUSTRATED EMBODIMENT

The illustrated example relates to an internal combustion engine with self-ignition (i.e., without sparkplugs), in which during the starting-up phase the fuel-air mixture in the combustion chamber of the engine is brought to ignition temperature with the help of glow plugs. The installation according to the invention for control of the temperature of these glow plugs, however, is in general correspondingly usable in all kinds of internal combustion engines.

Figure 1:
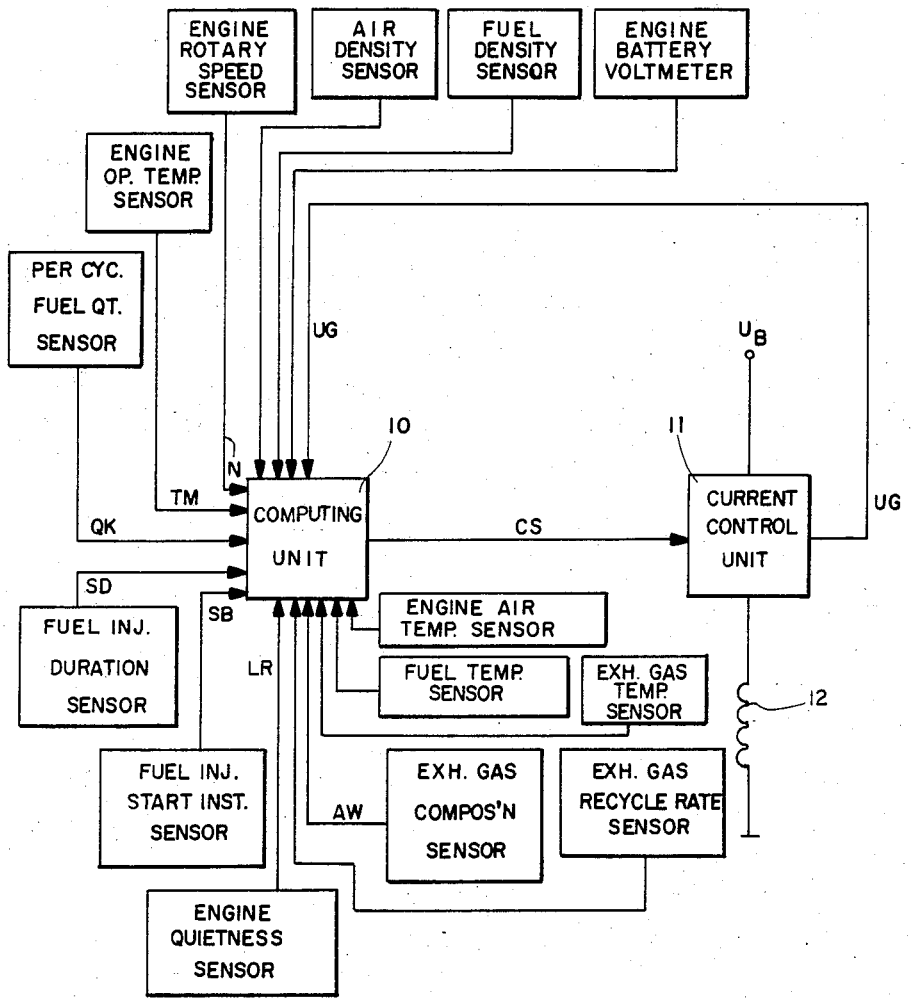
FIG. 1 shows a block circuit diagram of an insulation for control of the temperature in a glow plug in a cylinder of the engine.

FIG. 1 of the drawing shows a block circuit diagram of the glow plug temperature control system. The reference numeral 10 identifies a computing device for deriving a control signal from various inputs, which may be constituted according to analog circuit technology, but which can also be constructed as a programmed digital computer or microcomputer. The circuit block 11 includes a current control element which may be a relay or a transistor circuit. A glow plug is shown at 12. The computing unit 10 responds to input signals provided at various inputs, including signals representative, for example, of engine rotary speed N, operating temperature of the engine TM, quantity of fuel QK per cycle, duration of fuel injection SD over which fuel is supplied to the engine from the initial instant SB at which the injection begins, etc. Still more signals representing engine parameter values are supplied to the computing unit 10, as for example a signal representative of the quietness of operation LR of the engine, a signal representative of the composition of the exhaust gases of the engine AW, and so on. Finally, still another signal UG is supplied to the computing unit 10. The output signal of the computing unit 10 is connected to the current control unit 11. The latter is connected to a source of voltage supply $U_B$ and also through the glow plug 12 to ground. Finally, the signal UG that represents the voltage applied to the glow plug is fed back from the current control unit 11 to the computing unit 10.

For effective support of combustion in the engine, it is essential that the temperature of the glow plug TG should not fall below a lower predetermined temperature value TU, for example about 900° C. At the same time, however, the rise of the temperature of the glow plug TG above a predetermined upper temperature boundary TO, for example about 1050° C., must be prevented under all conditions of operation. The rise of the glow plug temperature above this upper temperature boundary substantially shortens the service life of the glow plugs.

It is now possible, by use of suitable test devices and investigation procedures, to determine the effect of operating parameters of the internal combustion engine on the temperature of the glow plugs, thus for example the dependency of the temperature of the glow plugs TG upon the crankshaft speed N, the operating temperature of the engine TM, on the quantity of fuel QK supplied per cycle to the engine, on the injection duration SD, on the beginning time of injection SB, etc. With these dependency characteristics suitably put in memory, the computer unit 10 now produces an output signal responsive to the above-named operating parameters that are supplied to it, which output signal is supplied to the current control unit 11, by which the supply of energy (electrical current) to the glow plug is varied. The output signal of the computing unit 10 can, for example, be a binary signal, thus a digital pulse signal, by which the energy supplied to the glow plug is defined by the keying ratio, thus by the ratio of on and off time of the pulse. It is of course also possible to provide the output signal of the computing unit 10 as an analog voltage by which a power transistor final stage is controlled, which in turn determines the current supplied to the glow plug.

The magnitude of the output signal of the computing unit 10, and thereby the magnitude of the energy supplied to the glow plug is so determined by the computing unit 10 that the temperature of the glow plug TG remains always above the lower boundary temperature TU and below the upper boundary temperature TO. The relation between the energy supplied to the glow plug and the temperature change thereby resulting for the particular engine is, like other characteristics, determined by test procedures in advance, so that the computing unit 10 can provide an efficient control signal to the current control unit 11.

It is not strictly necessary for determining the time duration of the supply of energy to the glow plug can be limited and/or fully shut off in a manner dependent upon at least the operating temperature of the engine, but it is not strictly necessary to provide such limiting or shutting off of energy supplied to the glow plug.

With the system as described up to this point, it is thus possible to control the temperature TG of the glow plug in such a way that it remains continously within a defined temperature region. This is possible by taking account of signals referring to the supply of fuel to the engine, thus by taking account of the high combustion temperatures after a successful start of the engine.

It is particularly advantageous to provide, in addition to the installation described up to now, for taking account of the voltage applied to the glow plug 12. For this purpose, the glow plug voltage UG is fed back to the computing unit 10 and is taken account of there in the formation of the output signal furnished to the current control unit 11, which means that this voltage is taken into account in the supply of energy to the glow plug. On an overall basis, therefore, by the feeding back of the glow plug voltage UG the control of the temperature of the glow plug TG is possible with concurrent taking account of the voltage applied to the glow plug. Possible fluctuations of the supply voltage $U_B$ can thus be regulated out and will not affect the quality of control of the glow plug temperature. It is also possible in this case to measure directly the current passing to the glow plug instead of measuring the voltage applied to the glow plug. It is also possible to measure the supply voltage $U_B$ directly and thereby to take directly into account the amount of energy to be supplied to the glow plug.

Figure 2:
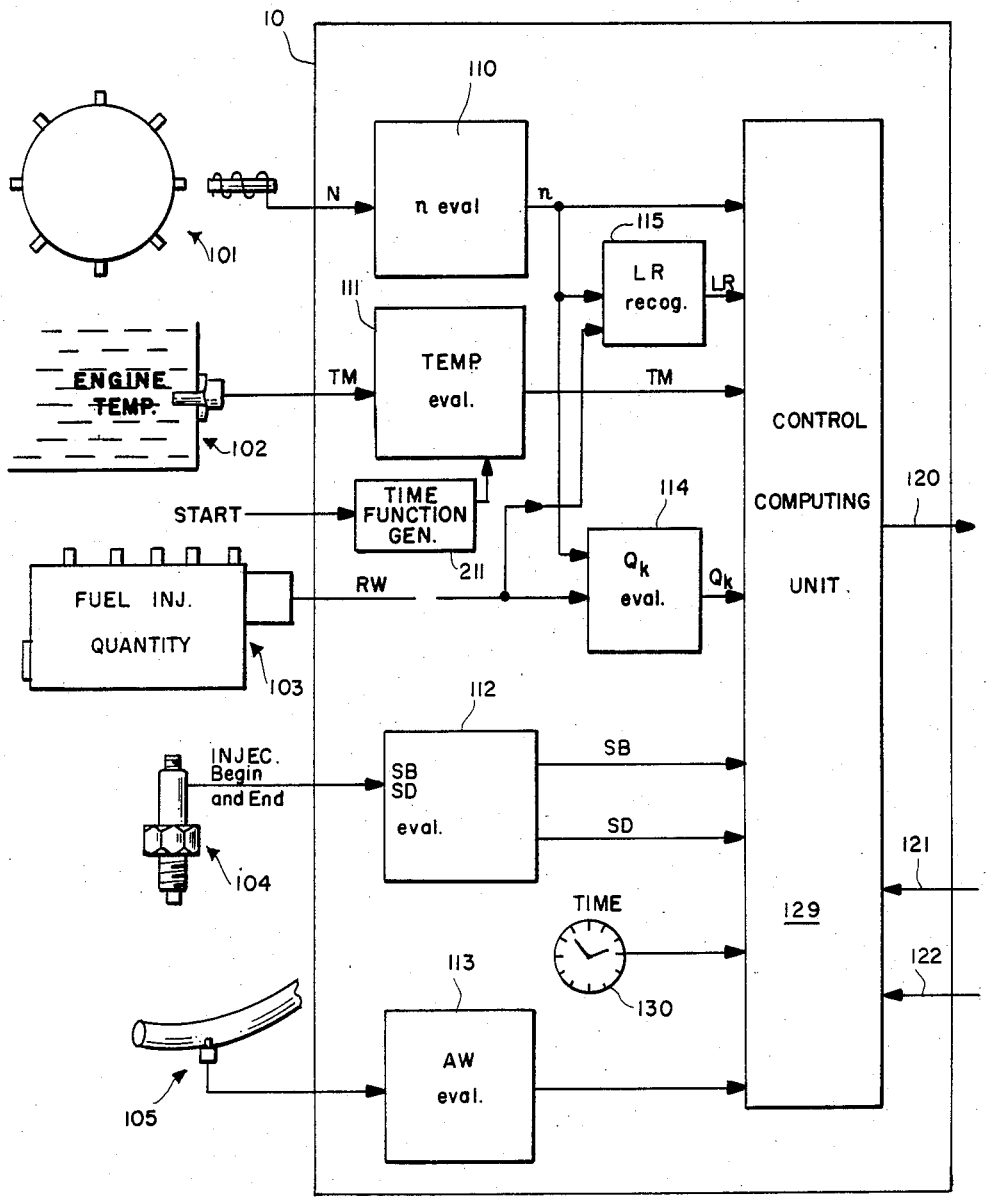
FIG. 2 is a more detailed circuit block diagram of the circuit block 10 of FIG. 1.

In FIG. 2, which is a more detailed representation of the unit 10 of FIG. 1, this control 10 is shown supplied with five different input signals, namely an engine speed signal N supplied by a tachogenerator 101, and an engine temperature signal TM supplied by an engine thermometer 102, a stroke length signal RW of a stroke length transducer 103 provided by a fuel injection stroke length sensor 103, fuel injection time signal from a fuel injection sensor 104 and an exhaust gas composition signal from an exhaust gas sensor 105.

The speed signal is evaluated by a circuit block 110 in the unit 10, the temperature signal by a temperature evaluation circuit 111, and the fuel injection time signal is evaluated so as to provide an injection beginning signal SB and an injection duration signal SD in a circuit 112. The exhaust gas sensor signal is evaluated in a circuit block 113 and the injection stroke signal in an evaluation circuit 114, to which the evaluated speed signal n is supplied by the circuit 110 to a second input of the circuit 114. The outputs of the stroke signal transducer 103 and of the speed signal evaluating circuit 110 are also supplied to a running noise recognition circuit 115. Finally, the outputs of the circuits 110, 115, 111, 114, 112 and 113, as well as the signal from a clock 130, are supplied through a control computing unit 129 which serves as an engine characteristic curve generator and an energy supply controller which also receives additional inputs 121 and 112. The control computing unit 129 provides an output 120. The unit 10, as a whole is also provided with energizing voltage from a battery connection designated by the term $U_{Batt}$.

Figure 3:
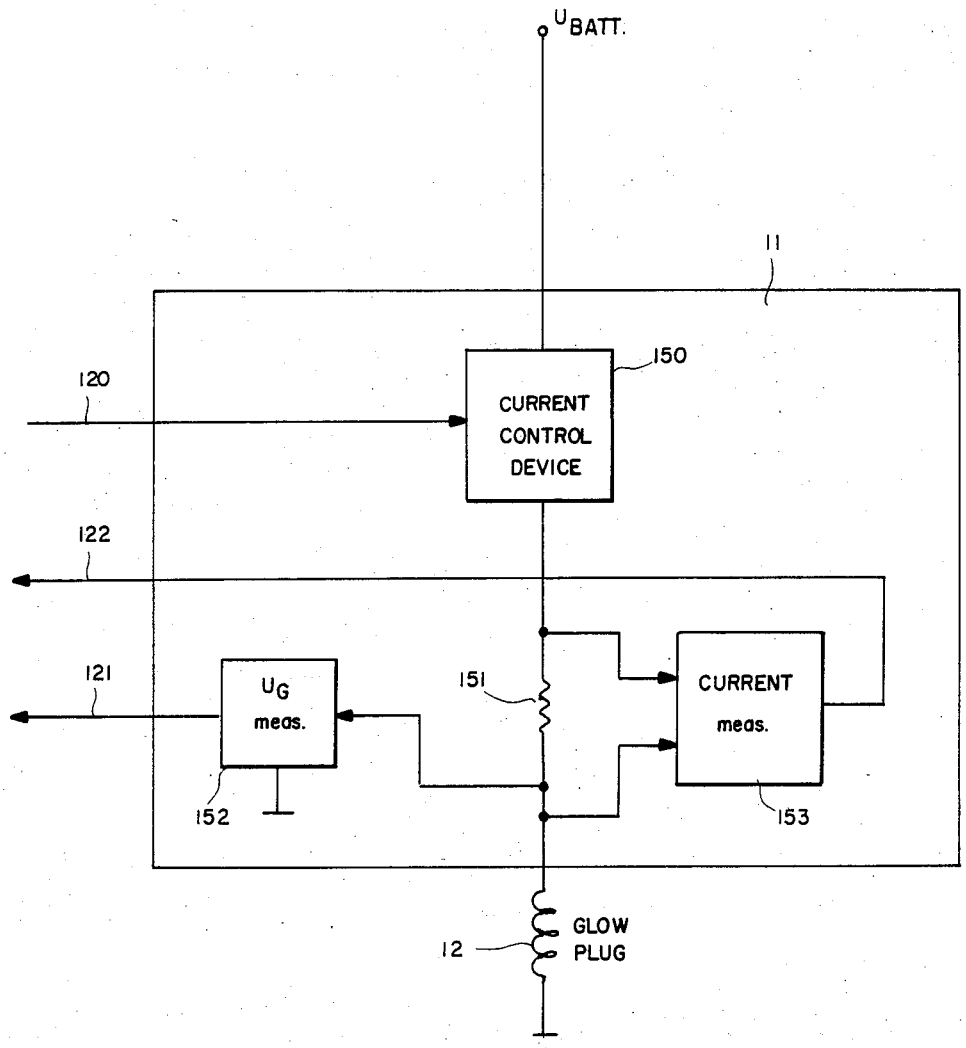
FIG. 3 is a more detailed circuit block diagram of circuit block 11 of FIG. 1.

FIG. 3, representing the unit 11 of FIG. 1, shows a series circuit running from the battery terminal $U_{Batt}$ through a current control device 150, a measuring resistance 151 and the glow plug 12, to ground (chassis). The current control device 150 is controlled by the output 120 of the control computing unit 129 of FIG. 2. At the common connection of the glow plug 12 and the measurement resistance 151, there is connected a conductor leading to a voltage measuring device 152 which produces an output signal 121 that represents the voltage applied to the glow plug 12. Connections from both ends of the measurement resistor 151 lead to a current measuring device 153 that produces an output representative of the magnitude of the current on the output line 122, the voltage and current measurement signals being supplied over the lines 121 and 120 as inputs to the control computing unit 129 of the unit 10.

It should be remarked that still further functions can be performed by the control signal unit 10 and likewise by the current control unit 11. It is also possible to combine the units 10 and 11, for example by providing a programmed microcomputer for performing all the functions of these two units.

A further elaboration of the control system of the invention which is particularly useful is to feed back the actual temperature of the glow plug, as measured by a thermosensitive element, instead of feeding back the glow plug voltage. In such a case, the measured actual temperature of the glow plug is compared with the desired temperature computed from operating parameters of the engine with reference to engine operating characteristics, with an output signal then being provided as the result of this comparison for controlling the current control unit 11 in such a way that the actual temperature of the glow plug is made to equal or to approach closely the desired temperature. By this further elaboration of the system of the invention, it is thus possible to provide an exact regulation of the glow plug temperature. As another advantageous elaboration of the system of the invention, it is possible to supply the computing unit 10 with additioanl signals referring to particular operating characteristics of the engine. For example, a signal relating to the quietness of operation LR of the engine can be supplied, or a signal representative of the composition of the exhaust gases AW, or the like. With the assistance of such signals, it is then possible for the computing unit 10 to modify the permitted operating range of the temperature of the glow plug. For example, it is advantageous when the engine quietness is improving, to reduce the permitted operating range of the temperature of the glow plug. The computing unit, accordingly, modifies overall the upper and the lower temperature boundaries TO and TU, for example in dependence on the above-mentioned signal LR and the above-mentioned signal AW. Still, the upper temperature limit may be varied only to the extent that it does not overstep the boundary beyond which the service life of the glow plug is reduced.

By taking the exhaust gas and the engine quietness into account, the result obtained is that the temperature TG of the glow plug is within a narrower operating range, which has a positive effect in favor of quiet and smoother operation of the engine.

Figure 4:
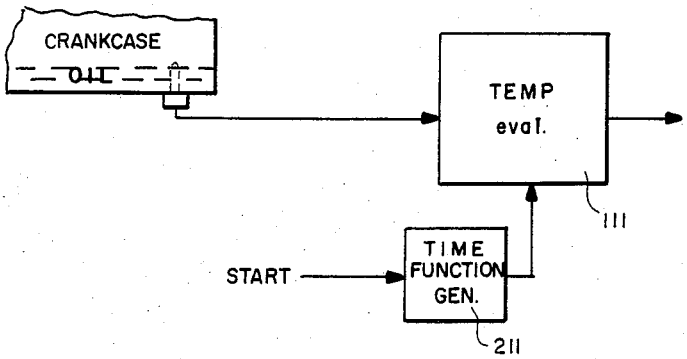
FIG. 4 is a circuit block detail diagram of one variant of a portion of FIG. 2.
Figure 5:
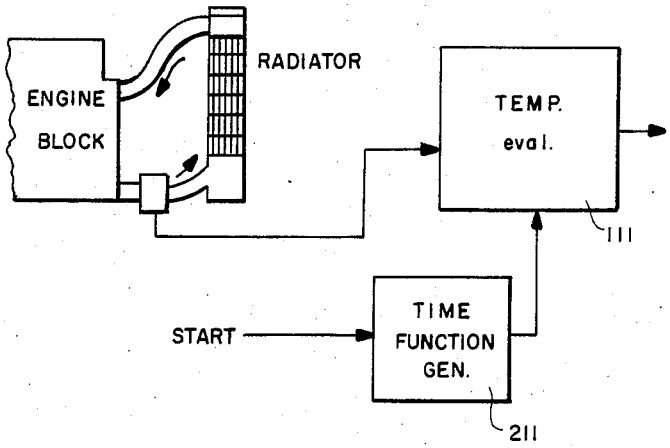
FIG. 5 is a circuit block detail diagram of a second variant of a portion of FIG. 2.

In still another advantageous elaboration of the system of the invention, the instantaneous combustion chamber temperature of the engine is taken into account in the control of the energy supplied to the glow plug. Since the instantaneous combustion chamber temperature is very difficult or quite impossible to measure, however, it is usually replaced by the operating temperature of the engine. Once the engine is warmed up, this substitution is possible without problems, since in this operating condition the difference between operating temperature and combustion chamber is somewhat constant. During the warming up phase, however, especially during the first few minutes after the starting of the engine, this difference is not constant but varies. In this operating phase, accordingly, the combustion chamber temperature cannot be directly replaced by the operating temperature of the engine. For this reason, it is particularly advantageous, especially for the first minutes of operation of the engine, to utilize a modified value of engine operating temperature which varies with time. This can be done by correlating with the operating temperature of the engine a time-dependent function representing the warm-up period of the engine produced by the function generator 211 of FIG. 2, with the result of producing a signal which represents as accurately as possible the instantaneous combustion chamber temperature of the engine. As soon as the engine has warmed up, which is to say as soon as the first few minutes of operation are past, the effect of the time-dependent function can almost vanish, since after the warm-up time the combustion chamber temperature can be derived quite accurately from the operating temperature of the engine alone. It is particularly advantageous in the last-mentioned modification of the system, to obtain the operating temperature of the engine, which is to say the motor temperature, by means of or in dependence on the temperature of the cooling medium of the engine, the engine oil temperature and/or the like, as illustrated in FIGS. 4 and 5.

It should further be mentioned that it is possible to supply input signals to the computing unit 10 (and to take them into account) for still other magnitudes characterizing the operating condition of the engine, for example the fuel and/or air temperature and/or the fuel and/or the air density and/or the exhaust gas temperature and/or exhaust recycling rate and/or the air quantity used per engine cycle, engine-charged battery voltage and so on. These possibilities are also shown in FIG. 1, although the signals produced are not given special designations there for these cases.

Although the invention has been described with reference to several illustrative embodiments all symbolically shown in the drawing, it is evident that variations and modifications are possible within the inventive concept. Furthermore, although it is usual to use glow plugs, which are separate components, to provide a hot spot within a combustion chamber of an internal combustion engine, it is also possible to provide such a hot spot without the provision of a separate plug, for which reason it is convenient to refer generally to the provision of hot spots and electrical heating means for such hot spots through which an electric current flows, which is controlled by a control unit or means in response to the output signal of a unit that may be referred to as a computing unit, or as an evaluating unit or means.

We claim:

1. A starting resistance system for a diesel engine having a plurality of cylinders, said system comprising a glow plug in each cylinder, electrical heaters in each of said glow plugs, means for supplying electrical current to said heaters and means for controlling said current supplying means so that a predetermined maximum current flows through said glow plugs during an engine start beginning when the engine is at ambient temperature and said current is subject to be reduced in value in a manner dependent on engine operating parameters after the engine is started, siad controlling means including:

means for producing a first engine operating parameter electrical signal representative of the amount of fuel supplied to said cylinders for a firing cycle of the engine;

means for producing a second engine operating parameter electrical signal representative of engine intake air temperature;

means for producing a third engine operating parameter electrical signal representative of engine operating temperature;

means for producing a signal (UG) representative of an energization parameter of said glow plugs;

means for correlating said first, second and third engine operating parameter electrical signals together with said signal (UG) representative of an energization parameter of said glow plugs to produce a control signal (CS), and means for applying said control signal to control said current supplying means in a manner maintaining said energization parameter of said glow plugs within a predetermine range of values thereof.

2. System according to claim 1, in which said first signal representative of the amount of fuel to said cylinders is a signal representative of the duration of fuel injection in an individual fuel injection operation.

3. System according to claim 1, in which said first signal representative of the amount of fuel to said cylinders is a signal representative of the instant of beginning of fuel injection.

4. System according to claim 1, in which said means for producing a signals (UG) representative of an energization parameter of said glow plugs is constituted as means for producing a signal representative of the amount of electric current flowing through said glow-plug heaters.

5. System according to claim 1, in which said means for producing a signal (UG) representative of an energization parameter of said glow plugs is constituted as means for producing a signal representative of the actual temperature of said glow plugs.

6. System according to claim 5, in which said correlating means includes means for comparing the value of said glow plug temperature representative signal with at least one reference value thereof, said correlating means being constituted so as to provide said control signal in a magnitude and sign tending to maintain the temperature of said glow plugs within a predetermined optimum operating range.

7. System according to claim 5, in which said correlating means includes means for comparing the value of said glow plug temprature representative signal with at least one reference value thereof, said correlating means being constituted so that when said engine is running after a successful start thereof, said control signal is produced in a manner tending to maintain the temperature of said glow plugs within a predetermined operating temperature range.

8. System according to claim 1, in which means are provided for producing a fourth engine operating parameter electrical signal representative of engine quietness and said correlating means is constituted for correlating said fourth engine operating parameter electrical signal along with said first, second and third engine operating parameter electrical signals and said signal (UG) representative of an energization parameter of said glow plugs, to produce said control signal (CS).

9. System according to claim 1, in which means are provided for producing a fifth engine operating parameter electrical signal representative of the composition of exhaust gases of said engine and said correlating means is constituted for correlating said fifth engine operating parameter electrical signal along with said first, second and third engine operating parameter electrical signals and said signal (UG) representative of an energization parameter of said glow plugs to produce said control signal (CS).

10. System according to claim 1, in which means are provided for producing a sixth engine operating parameter electrical signal representative of rotary speed of said engine and said correlating means is constituted for correlating said sixth engine operating parameter electrical signal along with said first, second and third engine operating parameter electrical signals and said signal (UG) representative of an energization parameter of said glow plug to produce said control signal (CS).

11. System according to claim 1, in which means are provided to produce, as additional engine operating parameter electrical signal, a signal representative of at least one of the following: fuel temperature, air temperature, fuel density, air density, air quantity charged in said cylinders, engine-charged battery voltage, exhaust gas temperature and exhaust gas recirculation rate.

12. System according to claim 1, in which said third engine operating parameter electrical signal representative of the operating temperature of said engine is connected to means forming a part of said correlating means for turning off at least in part the current supply to said glow-plug heaters when said engine operating temperature exceeds a predetermined value.

13. System according to claim 1, in which means are provided for producing a seventh engine operating parameter electrical signal representative of the instantaneous combustion chamber temperature in said cylinders and said correlating means is constituted for correlating said seventh engine operating parameter electrical signal along with said first, second and third engine operating parameter electrical signals and said signal (UG) representative of an energization parameter of said glow plugs to produce said control signal (CS).

14. System according to claim 13, in which said means for providing said seventh engine operating parameter electrical signal are included in a simulator incorporated in said correlating means and having as input signals said third engine operating parameter electrical signal and a signal in the form of a time-dependent function representing the period for which the engine has been running hot produced at the output of a function generator (211).

15. System according to claim 14, in which said means for producing said third engine operating parameter electrical signal are constituted as means for producing a signal representing the temperature of cooling water in said engine.

16. System according to claim 13, in which said means for producing said third engine operating parameter electrical signal is constituted as means for producing a signal representative of the temperature of oil circulating in said engine.

* * * * *